US009001167B2

(12) United States Patent
Credelle et al.

(10) Patent No.: US 9,001,167 B2
(45) Date of Patent: Apr. 7, 2015

(54) DISPLAY PANEL HAVING CROSSOVER CONNECTIONS EFFECTING DOT INVERSION

(75) Inventors: Thomas Lloyd Credelle, Morgan Hill, CA (US); Matthew Osborne Schlegel, Palo Alto, CA (US)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 13/458,984

(22) Filed: Apr. 27, 2012

(65) Prior Publication Data

US 2012/0206509 A1 Aug. 16, 2012

Related U.S. Application Data

(60) Division of application No. 13/232,546, filed on Sep. 14, 2011, which is a continuation of application No. 10/455,925, filed on Jun. 6, 2003, now Pat. No. 8,035,599.

(51) Int. Cl.
*G09G 3/36* (2006.01)

(52) U.S. Cl.
CPC ..... *G09G 3/3614* (2013.01); *G09G 3/3648* (2013.01); *G09G 2300/08* (2013.01); *G09G 2310/0254* (2013.01); *G09G 2320/0214* (2013.01); *G09G 2320/0285* (2013.01)

(58) Field of Classification Search
USPC ..... 345/87, 54, 79, 96, 209, 690, 694, 695
See application file for complete search history.

(56) References Cited

U.S. PATENT DOCUMENTS

| | | | |
|---|---|---|---|
| 3,971,065 | A | 7/1976 | Bayer |
| 4,353,062 | A | 10/1982 | Lorteije et al. |
| 4,642,619 | A | 2/1987 | Togashi |
| 4,651,148 | A | 3/1987 | Takeda et al. |
| 4,773,737 | A | 9/1988 | Yokono et al. |
| 4,781,438 | A | 11/1988 | Noguchi |
| 4,800,375 | A | 1/1989 | Silverstein et al. |

(Continued)

FOREIGN PATENT DOCUMENTS

| | | | |
|---|---|---|---|
| EP | 0 203 005 | A1 | 11/1986 |
| EP | 0 322 106 | A2 | 6/1989 |

(Continued)

OTHER PUBLICATIONS

Brown Elliott, C., "Active Matrix Display . . . ", IDMC 2000, 185-189. Aug. 2000.

(Continued)

*Primary Examiner* — Kathy Wang-Hurst
*Assistant Examiner* — Jose Soto Lopez
(74) *Attorney, Agent, or Firm* — Innovation Counsel LLP

(57) ABSTRACT

A display device having subpixel repeating groups is presented. Each subpixel repeating group has an even number of four or more subpixels and includes odd-numbered subpixels and even-numbered subpixels alternately arranged in a row direction, each subpixel having a color. A data driver is configured to provide data signals to the subpixels such that the odd-numbered subpixels have a polarity that is opposite that of the even-numbered subpixels in each of the subpixel repeating groups. A first subpixel repeating group and a second subpixel repeating group are adjacent in the row direction. The first subpixel of the first subpixel repeating group and the first subpixel of the second subpixel repeating group have the same color and opposite polarities.

8 Claims, 10 Drawing Sheets

(56) References Cited

U.S. PATENT DOCUMENTS 4,822,142 A 4/1989 Yasui
4,853,592 A 8/1989 Strathman
4,874,986 A 10/1989 Menn et al.
4,886,343 A 12/1989 Johnson
4,908,609 A 3/1990 Stroomer
4,920,409 A 4/1990 Yamagishi
4,965,565 A 10/1990 Noguchi
5,006,840 A 4/1991 Hamada et al.
5,052,785 A 10/1991 Takimoto et al.
5,097,297 A 3/1992 Nakazawa
5,113,274 A * 5/1992 Takahashi et al. ..... 349/109
5,144,288 A 9/1992 Hamada et al.
5,184,114 A 2/1993 Brown
5,191,451 A 3/1993 Katayama et al.
5,311,205 A 5/1994 Hamada et al.
5,384,266 A 1/1995 Chapman
5,459,595 A 10/1995 Ishiguro
5,754,163 A 5/1998 Kwon
5,767,829 A 6/1998 Verhulst
5,808,594 A 9/1998 Tsubyama et al.
5,818,405 A 10/1998 Eglit et al.
5,818,968 A 10/1998 Yoshimoto
5,899,550 A 5/1999 Masaki
5,949,396 A 9/1999 Lee
5,971,546 A 10/1999 Park
6,069,670 A 5/2000 Borer
6,088,050 A 7/2000 Ng
6,097,367 A 8/2000 Kuriwaki et al.
6,100,861 A * 8/2000 Cohen et al. ..... 345/88
6,108,122 A 8/2000 Ulrich et al.
6,115,092 A 9/2000 Greene et al.
6,144,352 A 11/2000 Matsuda et al.
6,147,664 A 11/2000 Hansen
6,151,001 A 11/2000 Anderson et al.
6,160,535 A 12/2000 Park
6,188,385 B1 2/2001 Hill et al.
6,219,019 B1 4/2001 Hasegawa
6,219,025 B1 4/2001 Hill et al.
6,225,967 B1 5/2001 Hebiguchi
6,225,973 B1 5/2001 Hill et al.
6,236,390 B1 5/2001 Hitchcock
6,239,783 B1 5/2001 Hill et al.
6,243,055 B1 6/2001 Fergason
6,243,070 B1 6/2001 Hill et al.
6,278,434 B1 8/2001 Hill et al.
6,326,981 B1 12/2001 Mori et al.
6,327,008 B1 12/2001 Fujiyoshi
6,332,030 B1 12/2001 Manjunath et al.
6,335,719 B1 * 1/2002 An et al. ..... 345/98
6,340,970 B1 1/2002 Furuhashi et al.
6,340,998 B1 1/2002 Kim et al.
6,342,876 B1 1/2002 Kim
6,348,929 B1 2/2002 Acharya et al.
6,377,262 B1 4/2002 Hitchcock et al.
6,388,644 B1 5/2002 De Zwart et al.
6,392,717 B1 5/2002 Kunzman
6,393,145 B2 5/2002 Betrisey et al.
6,396,505 B1 5/2002 Lui et al.
6,469,756 B1 10/2002 Booth, Jr.
6,469,766 B2 10/2002 Waterman et al.
6,545,653 B1 4/2003 Takahara et al.
6,552,706 B1 4/2003 Ikeda et al.
6,570,584 B1 5/2003 Cok et al.
6,590,555 B2 7/2003 Su et al.
6,624,828 B1 9/2003 Dresevic et al.
6,661,429 B1 12/2003 Phan
6,674,436 B1 1/2004 Dresevic et al.
6,680,761 B1 1/2004 Greene et al.
6,714,206 B1 3/2004 Martin et al.
6,714,212 B1 3/2004 Tsuboyama et al.
6,714,243 B1 3/2004 Mathur et al.
6,727,878 B2 4/2004 Okuzono et al.
6,738,204 B1 5/2004 Chuang et al.
6,750,875 B1 6/2004 Keely, Jr. et al.
6,771,028 B1 8/2004 Winters
6,804,407 B2 10/2004 Weldy
6,833,888 B2 * 12/2004 Song et al. ..... 349/106
6,833,890 B2 12/2004 Hong et al.
6,836,300 B2 12/2004 Choo et al.
6,850,294 B2 2/2005 Roh et al.
6,867,549 B2 3/2005 Cok et al.
6,885,380 B1 4/2005 Primerano et al.
6,888,604 B2 5/2005 Rho et al.
6,897,876 B2 5/2005 Murdoch et al.
6,903,378 B2 6/2005 Cok
6,903,754 B2 6/2005 Brown Elliott
6,927,754 B2 8/2005 Lai
6,989,876 B2 1/2006 Song et al.
7,151,518 B2 12/2006 Fukumoto
7,187,353 B2 3/2007 Credelle et al.
7,209,105 B2 4/2007 Elliott
7,218,301 B2 5/2007 Credelle
7,230,667 B2 6/2007 Shin et al.
7,397,455 B2 7/2008 Elliott et al.
2001/0015716 A1 8/2001 Kim
2001/0017607 A1 8/2001 Kwon et al.
2001/0052897 A1 12/2001 Nakano et al.
2002/0008687 A1 * 1/2002 Tazuke ..... 345/96
2002/0015110 A1 2/2002 Brown Elliott
2002/0071086 A1 * 6/2002 Kim et al. ..... 349/152
2002/0093476 A1 7/2002 Hill et al.
2002/0158997 A1 10/2002 Fukami et al.
2002/0196267 A1 * 12/2002 Obayashi et al. ..... 345/690
2003/0006978 A1 1/2003 Fujiyoshi
2003/0011603 A1 1/2003 Koyama et al.
2003/0071943 A1 4/2003 Choo et al.
2003/0077000 A1 4/2003 Blinn et al.
2003/0090581 A1 5/2003 Credelle et al.
2003/0146893 A1 * 8/2003 Sawabe ..... 345/89
2003/0189537 A1 10/2003 Yun
2003/0214499 A1 11/2003 Ohsawa et al.
2003/0218618 A1 11/2003 Phan
2004/0008208 A1 1/2004 Dresevic et al.
2004/0021804 A1 2/2004 Hong et al.
2004/0061710 A1 4/2004 Messing et al.
2004/0085495 A1 5/2004 Roh et al.
2004/0094766 A1 5/2004 Lee et al.
2004/0095521 A1 5/2004 Song et al.
2004/0104873 A1 6/2004 Kang et al.
2004/0108818 A1 6/2004 Cok et al.
2004/0114046 A1 6/2004 Lee et al.
2004/0150651 A1 8/2004 Phan
2004/0155895 A1 8/2004 Lai
2004/0169807 A1 9/2004 Rho et al.
2004/0174389 A1 9/2004 Ben-David et al.
2004/0179160 A1 9/2004 Rhee et al.
2004/0189662 A1 9/2004 Frisken et al.
2004/0189664 A1 9/2004 Frisken et al.
2004/0213449 A1 10/2004 Safee-Rad et al.
2004/0223005 A1 11/2004 Lee
2004/0239813 A1 12/2004 Klompenhouwer
2004/0239837 A1 12/2004 Hong et al.
2004/0246278 A1 12/2004 Elliott
2004/0246279 A1 12/2004 Credelle et al.
2004/0246280 A1 12/2004 Credelle et al.
2004/0246381 A1 12/2004 Credelle
2004/0246404 A1 12/2004 Elliott et al.
2004/0247070 A1 12/2004 Ali et al.
2004/0263528 A1 12/2004 Murdoch et al.
2005/0007539 A1 1/2005 Taguchi et al.
2005/0024380 A1 2/2005 Lin et al.
2005/0040760 A1 2/2005 Taguchi et al.
2005/0068477 A1 3/2005 Shin et al.
2005/0083277 A1 4/2005 Credelle
2005/0083356 A1 4/2005 Roh et al.
2005/0099426 A1 5/2005 Primerano et al.
2005/0140634 A1 6/2005 Takatori
2005/0151752 A1 7/2005 Phan
2005/0162600 A1 7/2005 Rho et al.
2005/0212728 A1 9/2005 Miller et al.

(56) References Cited

U.S. PATENT DOCUMENTS

| | | | |
|---|---|---|---|
| 2005/0219274 | A1 | 10/2005 | Yang et al. |
| 2007/0146270 | A1 | 6/2007 | Credelle et al. |

FOREIGN PATENT DOCUMENTS

| | | | |
|---|---|---|---|
| EP | 0 453 033 | A2 | 10/1991 |
| EP | 1 381 020 | A2 | 1/2004 |
| GB | 2 146 478 | A | 4/1985 |
| GB | 2 282 928 | A | 4/1995 |
| JP | 60-107022 | | 6/1985 |
| JP | 06-324649 | | 11/1994 |
| JP | 6-324649 | | 11/1994 |
| JP | 08-202317 | | 8/1996 |
| JP | 11-282008 | | 10/1999 |
| JP | 2004-004822 | | 1/2004 |
| JP | 2004 078218 | | 3/2004 |
| WO | 02/099557 | A2 | 12/2002 |
| WO | 02/101644 | A2 | 12/2002 |
| WO | 03/014819 | A1 | 2/2003 |
| WO | 03/050605 | A1 | 2/2003 |
| WO | 03/034380 | A2 | 4/2003 |
| WO | 03/056383 | A1 | 7/2003 |
| WO | 2004/017129 | A1 | 2/2004 |
| WO | 2004/021323 | A2 | 3/2004 |
| WO | 2004/027503 | A1 | 4/2004 |
| WO | 2004/086128 | A1 | 10/2004 |
| WO | 2005/050296 | A1 | 6/2005 |

OTHER PUBLICATIONS

Brown Elliott, C. "Color Subpixel Rendering Projectors and Flat Panel Displays", SMPTE, Feb. 27-Mar. 1, 2003, Seattle, WA pp. 1-4.
Credelle, Thomas, "P-00" MTF of High-Resolution PenTile Matrix Displays, Eurodisplay 02 Digest, 2002 pp. 1-4.
Daly, Scott, "Analysis of Subtriad Addressing Algorithms by Visual System Models", SID Symp. Digest, Jun. 2001 pp. 1200-1203.
Klompenhouwer, Michiel, Subpixel Image Scaling for Color Matrix Displays, SID Symp. Digest, May 2002, pp. 176-179.
Krantz, John et al., Color Matrix Display Image Quality: The Effects of Luminance . . . SID 90 Digest, pp. 29-32.
Lee, Baek-woon et al., 40.5L: Lat-News Paper: TFT-LCD with RGBW Color system, SID 03 Digest, 2003, pp. 1212-1215.
Messing, Dean et al., Improved Display Resolution of Subsampled Colour Images Using Subpixel Addressing, IEEE ICIP 2002, vol. 1, pp. 625-628.
Messing, Dean et al., Subpixel Rendering on Non-Strip Colour Matrix Displays, 2003 International Conf on Image Processing, Sep. 2003, Barcelona, Spain, 4 pages.
Okumura et al., "A New Flicker-Reduction Drive Method for High Resolution LCTVs", SID Digest, pp. 551-554, 2001.
USPTO, Final Office Action dated Jun. 9, 2005 in US Patent Publication No. 2004/0246404 (U.S. Appl. No. 10/456,838).
Clairvoyante Inc. Response to Final Office Action dated Mar. 20, 2006 in US Patent Publication No. 2004/0246404 (U.S. Appl. No. 10/456,838).
USPTO, Non-Final Office Action dated Mar. 20, 2006 in US Patent Publication No. 2004-0246404 (U.S. Appl. No. 10/456,838).
Clairvoyante Inc. Response to Non-Final Office Action dated Sep. 14, 2006 in US Patent Publication No. 2004/0246404 (U.S. Appl. No. 10/456,838).
USPTO, Non-Final Office Action dated Mar. 20, 2006 in US Patent Publication No. 2004/0246280 (U.S. Appl. No. 10/456,839).
Clairvoyante Inc. Response to Non-Final Office Action dated Jun. 20, 2006 in US Patent Publication No. 2004/0246280 (U.S. Appl. No. 10/456,839).
USPTO, Final Office Action dated Aug. 29, 2006 in US Patent Publication No. 2004/0246280 (U.S. Appl. No. 10/456,839).
USPTO, Non-Final Office Action dated May 4, 2006 in US Patent Publication No. 2005/0083277 (U.S. Appl. No. 10/696,236).
Clairvoyante Inc. Response to Non-Final Office Action dated Aug. 4, 2006 in US Patent Publication No. 2005/0083277 (U.S. Appl. No. 10/696,236).
USPTO, Final Office Action dated Oct. 17, 2006 in US Patent Publication No. 2005/0083277 (U.S. Appl. No. 10/696,236).
Clairvoyante Inc. Response to Non-Final Office Action dated Oct. 2, 2006 in US Patent Publication No. 2004/0246381 (U.S. Appl. No. 10/455,931).
USPTO, Non-Final Office Action dated Jan. 23, 2006 in US Patent Publication No. 2004/0246278 (U.S. Appl. No. 10/455,927).
Clairvoyante Inc. Response to Non-Final Office Action dated May 19, 2006 in US Patent Publication No. 2004/0246278 (U.S. Appl. No. 10/455,927).
USPTO, Final Office Action dated Aug. 9, 2006 in US Patent Publication No. 2004/0246278 (U.S. Appl. No. 10/455,927).
USPTO, Non-Final Office Action dated Oct. 19, 2005 in US Patent Publication No. 2004/0246279 (U.S. Appl. No. 10/456,806).
Clairvoyante Inc. Response to Non-Final Office Action dated Jan. 18, 2005 in US Patent Publication No. 2004/0246279 (U.S. Appl. No. 10/46,806).
USPTO, Final Office Action dated May 2, 2006 in US Patent Publication No. 2004/0246279 (U.S. Appl. No. 10/456,806).
Clairvoyante Inc. Response to Final Office Action dated Aug. 2, 2006 in US Patent Publication No. 2004/0246279 (U.S. Appl. No. 10/46,806).
USPTO, Non-Final Office Action dated Sep. 2, 2004 in US Patent Publication No. 2004/0246404 (U.S. Appl. No. 10/456,838).
Clairvoyante Inc. Response to Non-Final Office Action dated Jan. 28, 2005 in US Patent Publication No. 2004/0246404 (U.S. Appl. No. 10/456,838).
Brown Elliott, C, "Co-Optimization of Color AMLCD Subpixel Architecture and Rendering Algorithms," SID 2002 Proceedings Paper, May 30, 2002 pp. 172-175.
Brown Elliott, C, "New Pixel Layout for Pen Tile MatrixTM Color AMLCD Subpixel Architecture and Rendering Algorithms", SID 2003, Journal Article.
Brown Elliott, C, "Pentile MatrixTM Display and Drivers" ADEAC Proceedings Paper, Portland OR., Oct. 2005.
Brown Elliott, C, "Reducing Pixel Count Without Reducing Image Quality", Information Display Dec. 1999, vol. 1, pp. 22-25.
USPTO, Non-Final Office Action dated Oct. 19, 2004 in US Patent Publication No. 2004/0246381 (U.S. Appl. No. 10/455,931).
Clairvoyante Inc. Response to Non-Final Office Action dated Jan. 18, 2005 in US Patent Publication No. 2004/0246381 (U.S. Appl. No. 10/455,931).
USPTO, Final Office Action dated Jul. 12, 2005 in US Patent Publication No. 2004/0246381 (U.S. Appl. No. 10/455,931).
Clairvoyante Inc. Response to Final Office Action dated Jan. 12, 2006 in US Patent Publication No. 2004/0246381 (U.S. Appl. No. 10/455,931).
USPTO, Non-Final Office Action dated May 1, 2006 in US Patent Publication No. 2004/0246381 (U.S. Appl. No. 10/455,931).
Clairvoyante Inc. Response to Final Office Action dated Jun. 18, 2007 in US Patent Publication No. 2004/0246404 (U.S. Appl. No. 10/456,838).
Clairvoyante Inc. Response to Final Office Action dated Feb. 21, 2007 in US Patent Publication No. 2004/0246280 (U.S. Appl. No. 10/456,839).
USPTO, Non-Final Office Action dated May 16, 2007 in US Patent Publication No. 2004/0246280 (U.S. Appl. No. 10/456,839).
Clairvoyante Inc. Response to Final Office Action dated Mar. 16, 2007 in US Patent Publication No. 2005/0083277 (U.S. Appl. No. 10/696,236).
USPTO, Non-Final Office Action dated May 23, 2007 in US Patent Publication No. 2005/0083277 (U.S. Appl. No. 10/696,236).
PCT International Search Report dated Dec. 9, 2005 for PCT/US04/18034 (U.S. Appl. No. 10/455,925).
PCT International Search Report dated Feb. 1, 2006 for PCT/US04/18038 (U.S. Appl. No. 10/455,931).
PCT International Search Report dated Mar. 15, 2006 for PCT/US04/18033 (U.S. Appl. No. 10/455,927).
PCT International Search Report dated Jan. 10, 2006 for PCT/US04/18035 (U.S. Appl. No. 10/456,806).

(56) References Cited

OTHER PUBLICATIONS

PCT International Search Report dated Sep. 24, 2004 for PCT/US04/17796 (U.S. Appl. No. 10/456,838).
PCT International Search Report dated Nov. 3, 2004 for PCT/US04/18036 (U.S. Appl. No. 10/696,236).
Pollack, Joel, "Displays of a Different Stripe", IEEE Spectrum, Aug. 2006, pp. 40-44.
Clairvoyante Inc, Response to Non-Final Office Action dated Nov. 20, 2006 in US Patent Publication No. 2004/0246278 (U.S. Appl. No. 10/455,927).
USPTO, Notice of Allowance, dated Sep. 18, 2006 in US Patent No. 7,187,353 (U.S. Appl. No. 10/456,806).
USPTO, Final Office Action, dated Jan. 18, 2007 in US Patent Publication No. 2004/0246404 (U.S. Appl. No. 10/456,838).

* cited by examiner

DISPLAY PANEL HAVING CROSSOVER CONNECTIONS EFFECTING DOT INVERSION

RELATED APPLICATIONS

This application is a divisional of U.S. patent application Ser. No. 13/232,546, filed Sep. 14, 2011, which is a continuation of U.S. patent application Ser. No. 10/455,925, filed Jun. 6, 2003, now issued as U.S. Pat. No. 8,035,599 B2, which is related to commonly owned United States patent applications: (1) United States Patent Publication No. 2004/0246381 ("the '381 application") [U.S. patent application Ser. No. 10/455,931] entitled "SYSTEM AND METHOD OF PERFORMING DOT INVERSION WITH STANDARD DRIVERS AND BACKPLANE ON NOVEL DISPLAY PANEL LAYOUTS", and now issued as U.S. Pat. No. 7,218,301 B2; and (2) United States Patent Application Publication No. 2004/0246278 ("the '278 application") [U.S. patent application Ser. No. 10/455,927] entitled "SYSTEM AND METHOD FOR COMPENSATING FOR VISUAL EFFECTS UPON PANELS HAVING FIXED PATTERN NOISE WITH REDUCED QUANTIZATION ERROR" and now issued as U.S. Pat. No. 7,209,105 B2; (3) United States Patent Application Publication No. 2004/0246279 ("the '279 application") [U.S. patent application Ser. No. 10/456,806] entitled "DOT INVERSION ON NOVEL DISPLAY PANEL LAYOUTS WITH EXTRA DRIVERS" and now issued as U.S. Pat. No. 7,187,353 B2; (4) United States Patent Application Publication No. 2004/0246404 ("the '404 application") [U.S. patent application Ser. No. 10/456,838] entitled "LIQUID CRYSTAL DISPLAY BACKPLANE LAYOUTS AND ADDRESSING FOR NON-STANDARD SUBPIXEL ARRANGEMENTS"; and (5) United States Patent Application Publication No. 2004/0246280 ("the '280 application") [U.S. patent application Ser. No. 10/456,839] entitled "IMAGE DEGRADATION CORRECTION IN NOVEL LIQUID CRYSTAL DISPLAYS," which are hereby incorporated herein by their references.

BACKGROUND

In commonly owned United States patents and Published patent applications: (1) U.S. Pat. No. 6,903,754 ("the '754 patent") [U.S. patent application Ser. No. 09/916,232], entitled "ARRANGEMENT OF COLOR PIXELS FOR FULL COLOR IMAGING DEVICES WITH SIMPLIFIED ADDRESSING," filed Jul. 25, 2001; (2) United States Patent Publication No. 2003/0128225 ("the '225 application") [U.S. patent application Ser. No. 10/278,353], entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) United States Patent Publication No. 2003/0128179 ("the '179 application") [U.S. patent application Ser. No. 10/278,352], entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) United States Patent Publication No. 2004/0051724 ("the '724 application") [U.S. patent application Ser. No. 10/243,094], entitled "IMPROVED FOUR COLOR ARRANGEMENTS AND EMITTERS FOR SUB-PIXEL RENDERING," filed Sep. 13, 2002; (5) United States Patent Publication No. 2003/0117423 ("the '423 application") [U.S. patent application Ser. No. 10/278,328], entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) United States Patent Publication No. 2003/0090581 ("the '581 application") [U.S. patent application Ser. No. 10/278,393], entitled "COLOR DISPLAY HAVING HORIZONTAL SUB-PIXEL ARRANGEMENTS AND LAYOUTS," filed Oct. 22, 2002; (7) United States Patent Publication No. 2004/0080479 ("the '479 application") [U.S. patent application Ser. No. 10/347,001] entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003, novel sub-pixel arrangements are therein disclosed for improving the cost/performance curves for image display devices and herein incorporated by reference.

These improvements are particularly pronounced when coupled with sub-pixel rendering (SPR) systems and methods further disclosed in those applications and in commonly owned United States patent applications: (1) United States Patent Publication No. 2003/0034992 ("the '992 application") [U.S. patent application Ser. No. 10/051,612], entitled "CONVERSION OF A SUB-PIXEL FORMAT DATA TO ANOTHER SUB-PIXEL DATA FORMAT," filed Jan. 16, 2002, and now issued as U.S. Pat. No. 7,123,277 B2; (2) United States Patent Publication No. 2003/0103058 ("the '058 application") [U.S. patent application Ser. No. 10/150,355], entitled "METHODS AND SYSTEMS FOR SUB-PIXEL RENDERING WITH GAMMA ADJUSTMENT," filed May 17, 2002, and now issued as U.S. Pat. No. 7,221,381 B2; (3) United States Patent Publication No. 2003/0085906 ("the '906 application") [U.S. patent application Ser. No. 10/215,843], entitled "METHODS AND SYSTEMS FOR SUB-PIXEL RENDERING WITH ADAPTIVE FILTERING," filed Aug. 8, 2002, and now issued as U.S. Pat. No. 7,184,066 B2; (4) United States Patent Publication No. 2004/0196302 ("the '302 application") [U.S. patent application Ser. No. 10/379,767] entitled "SYSTEMS AND METHODS FOR TEMPORAL SUB-PIXEL RENDERING OF IMAGE DATA" filed Mar. 4, 2003; (5) United States Patent Publication No. 2004/0174380 ("the '380 application") [U.S. patent application Ser. No. 10/379,765] entitled "SYSTEMS AND METHODS FOR MOTION ADAPTIVE FILTERING," filed Mar. 4, 2003, and now issued as U.S. Pat. No. 7,167,186 B2; (6) U.S. Pat. No. 6,917,368 ("the '368 Patent") [U.S. patent application Ser. No. 10/379,766] entitled "SUB-PIXEL RENDERING SYSTEM AND METHOD FOR IMPROVED DISPLAY VIEWING ANGLES" filed Mar. 4, 2003, and now issued as U.S. Pat. No. 6,917,368 B2; (7) United States Patent Publication No. 2004/0196297 ("the '297 application") [U.S. patent application Ser. No. 10/409,413] entitled "IMAGE DATA SET WITH EMBEDDED PRE-SUBPIXEL RENDERED IMAGE" filed Apr. 7, 2003, which are hereby incorporated herein by reference.

BRIEF DESCRIPTION OF THE DRAWINGS

The accompanying drawings, which are incorporated in, and constitute a part of this specification illustrate exemplary implementations and embodiments of the invention and, together with the description, serve to explain principles of the invention.

DETAILED DESCRIPTION

Reference will now be made in detail to implementations and embodiments, examples of which are illustrated in the accompanying drawings. Wherever possible, the same reference numbers will be used throughout the drawings to refer to the same or like parts.

Figure 1A:
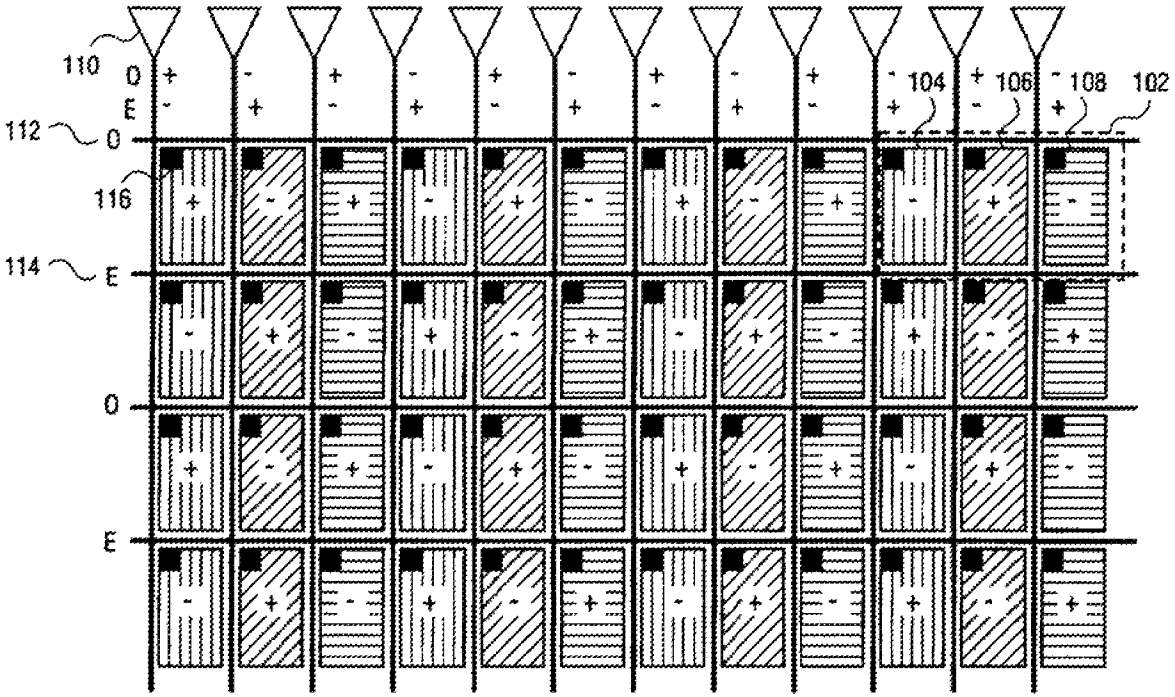
FIG. 1A (PRIOR ART)
FIG. 1A depicts a typical RGB striped panel display having a standard 1×1 dot inversion scheme.

FIG. 1A shows a conventional RGB stripe structure on panel 100 for an Active Matrix Liquid Crystal Display (AMLCD) having thin film transistors (TFTs) 116 to activate individual colored subpixels—red 104, green 106 and blue 108 subpixels respectively. As may be seen, a red, a green and a blue subpixel form a repeating group of subpixels 102 for panel 100.

As also shown, each subpixel is connected to a column line (each driven by a column driver 110) and a row line (e.g. 112 and 114). In the field of AMLCD panels, it is known to drive the panel with a dot inversion scheme to reduce crosstalk and flicker. FIG. 1A depicts one particular dot inversion scheme—i.e. 1×1 dot inversion—that is indicated by a "+" and a "−" polarity given in the center of each subpixel. Each row line is typically connected to a gate (not shown in FIG. 1A) of TFT 116. Image data—delivered via the column lines—are typically connected to the source of each TFT. Image data is written to the panel a row at a time and is given a polarity bias scheme as indicated herein as either ODD ("O") or EVEN ("E") schemes. As shown, row 112 is being written with ODD polarity scheme at a given time while row 114 is being written with EVEN polarity scheme at a next time. The polarities alternate ODD and EVEN schemes a row at a time in this 1×1 dot inversion scheme.

Figure 1B:
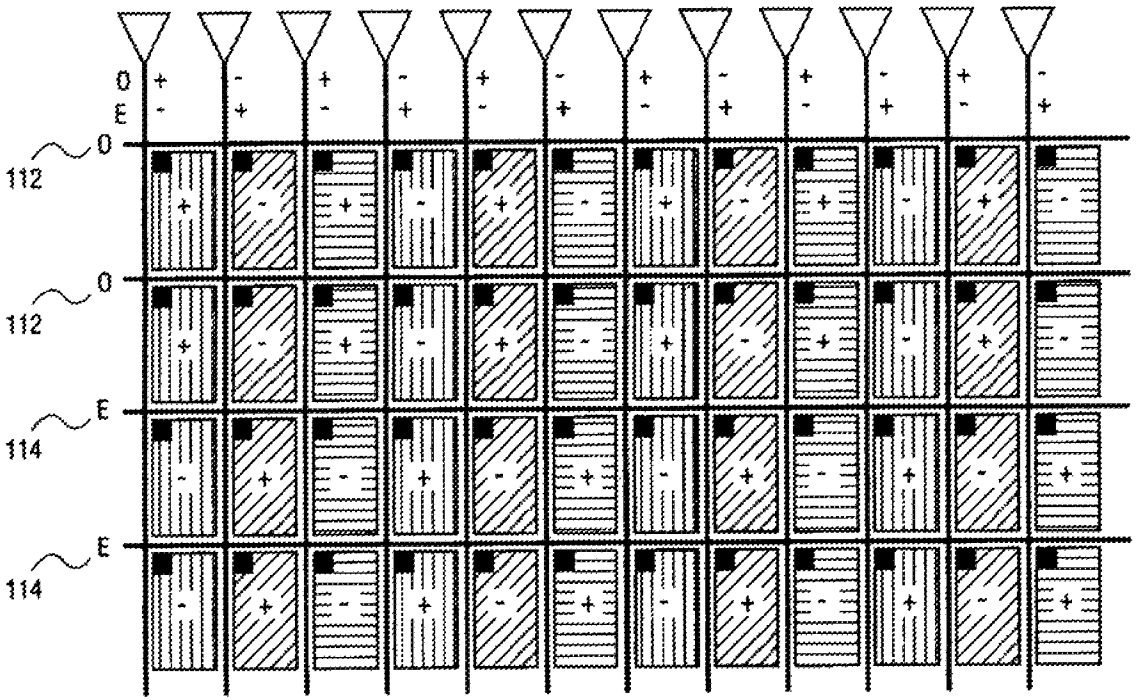
FIG. 1B (PRIOR ART)
FIG. 1B depicts a typical RGB striped panel display having a standard 1×2 dot inversion scheme.

FIG. 1B depicts another conventional RGB stripe panel having another dot inversion scheme—i.e. 1×2 dot inversion. Here, the polarity scheme changes over the course of two rows—as opposed to every row, as in 1×1 dot inversion. In both dot inversion schemes, a few observations are noted: (1) in 1×1 dot inversion, every two physically adjacent subpixels (in both the horizontal and vertical direction) are of different polarity; (2) in 1×2 dot inversion, every two physically adjacent subpixels in the horizontal direction are of different polarity; (3) across any given row, each successive colored subpixel has an opposite polarity to its neighbor. Thus, for example, two successive red subpixels along a row will be either (+,−) or (−,+). Of course, in 1×1 dot inversion, two successive red subpixels along a column having opposite polarity; whereas in 1×2 dot inversion, each group of two successive red subpixels will have opposite polarity. This changing of polarity decreases noticeable visual effects that occur with particular images rendered upon an AMLCD panel.

Figure 2:
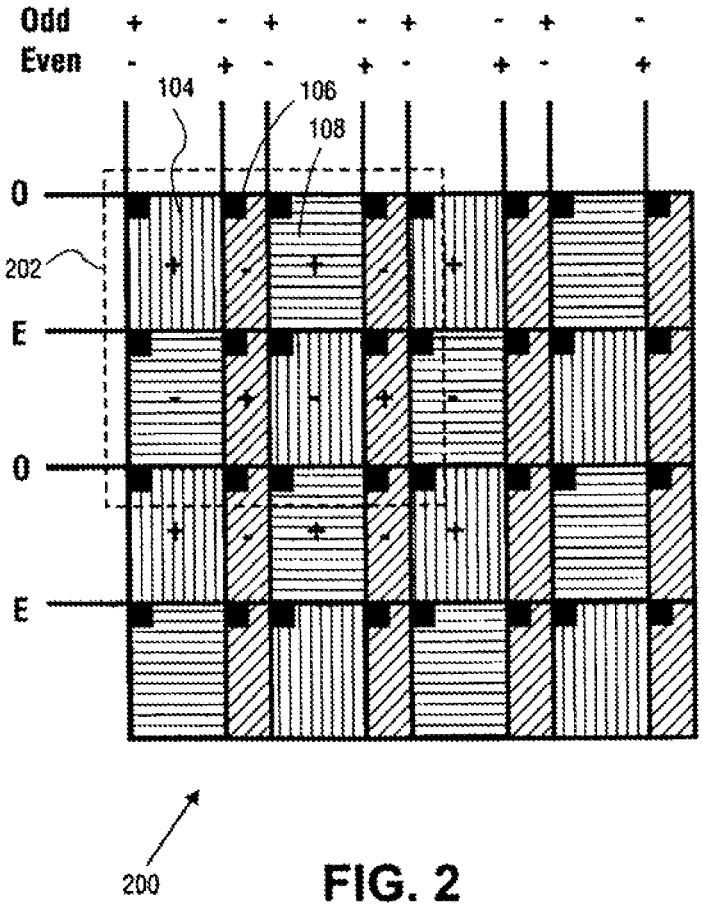
FIG. 2 depicts a novel panel display comprising a subpixel repeat grouping that is of even modulo.

FIG. 2 shows a panel comprising a subpixel repeating group 202, as further described in the '225 application. As may be seen, subpixel repeating group 202 is an eight subpixel repeat group, comprising a checkerboard of red and blue subpixels 104 and 108, respectively, with two columns of reduced-area green subpixels 106 in between. The following discussion may be applied to other subpixel repeating groups, such as a checkerboard of red and green with two columns of reduced area blue subpixels in between, without departing from the scope of the present invention. If the standard 1×1 dot inversion scheme is applied to a panel comprising such a repeating group (as shown in FIG. 2), then it becomes apparent that the property described above for RGB striped panels (namely, that successive colored pixels in a row and/or column have different polarities) is now violated. This condition may cause a number of visual defects noticed on the panel—particularly when certain image patterns are displayed. This observation also occurs with other novel subpixel repeating groups—for example, the subpixel repeating group in FIG. 1 of the '179 application—and other repeating groups that are not an odd number of repeating subpixels across a row. Thus, as the traditional RGB striped panels have three such repeating subpixels in its repeat group (namely, R, G and B), these traditional panels do not necessarily violate the above noted conditions.

Figure 9:
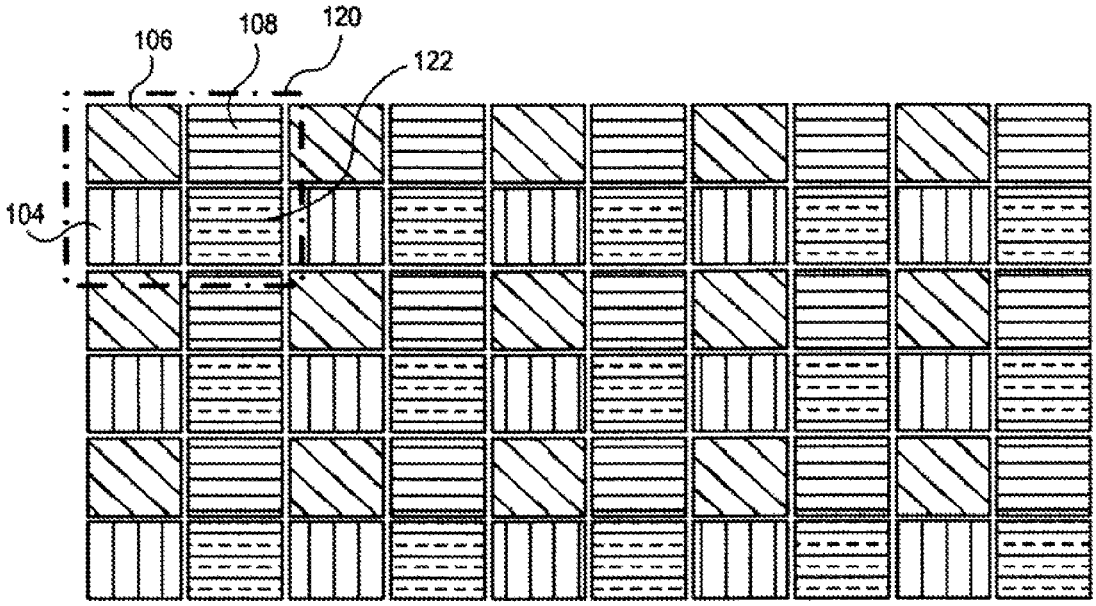
FIG. 9 (PRIOR ART)
FIG. 9 shows a prior art four color arrangement for a display using a repeat cell consisting of four subpixels.

Repeating group 202 of FIG. 2 in the present application, however, has four (i.e. an even number of) subpixels in its repeating group across a row (e.g. R, G, B, and G). It will be appreciated that the embodiments described herein are equally applicable to all such even modulus repeat groupings (i.e. 2, 4, 6, 8, etc subpixels across a row and/or column)—including the Bayer repeat pattern and all of its variants as well as several other layouts incorporated by reference from the patent applications listed above. For example, FIG. 9 is a prior art arrangement of four colors, sometimes called the Quad Arrangement, similar to the earlier Bayer pattern, but with one of the green subpixels replaced with a white. The repeat cell 120 consists of four subpixels, each of a different color, often red 104, green 106, blue 108, and white 122.

In the co-pending '232 application, now issued as U.S. Pat. No. 6,903,754 B2, there is disclosed various layouts and methods for remapping the TFT backplane so that, although the TFTs of the subpixels may not be regularly positioned with respect to the pixel element itself (e.g. the TFT is not always in the upper left hand corner of the pixel element), a suitable dot inversion scheme may be effected on a panel having an even modulo subpixel repeat grouping. Other possible solutions are possible and disclosed in the co-pending applications noted above.

If it is desired not to re-design the TFT backplane, and if it is also desired to utilize standard column drivers to effect a suitable dot inversion scheme, one possible implementation is to employ crossover connections to the standard column driver lines, as herein described. The first step to a final and suitable implementation is to design a polarity inversion pattern to suit the subpixel repeating group in question. For example, subpixel repeating group 202 of FIG. 2 looks like:

R G B G

B G R G with the R and B subpixels on a checkerboard and G subpixels interspersed between. Although FIG. 2 depicts that the green subpixels are of reduced area as compared to the red and blue subpixels themselves, it will be appreciated that all subpixels may be the same size or that other subpixel dimensioning is possible without departing from the scope of the present invention.

So, with the idea of choosing suitable polarity inversion patterns that would minimize flicker and crosstalk, the following are but a few exemplary embodiments disclosed:

Pattern 1: R+G+B+G−R−G+B−G−[REPEAT]
Pattern 2: R+G+B−G−R−G+B+G−[REPEAT]
Pattern 3: R+G−B+G+R−G−B−G+[REPEAT]
Pattern 4: R+G−B−G+R−G−B+G+[REPEAT]

First Embodiment of Pattern 1:

(+) 1. R+G+B+G−R−G+B−G−[REPEAT]
(+) 2. B−G−R−G+B+G−R+G+[REPEAT]
(−) 3. R−G−B−G+R+G−B+G+[REPEAT]
(−) 4. B+G+R+G−B−G+R−G−[REPEAT]

Second Embodiment of Pattern 1:

(+) 1. R+G+B+G−R−G+B−G−[REPEAT]
(+) 2. B−G−R−G+B+G−R+G+[REPEAT]
(−) 3. R−G+B−G−R+G+B+G−[REPEAT]
(−) 4. B+G−R+G+B−G−R−G+[REPEAT]

Patterns 1 through 4 above exemplify several possible basis patterns upon which several inversion schemes may be realized. A property of each of these patterns is that the polarity applied to each color alternates with each incidence of color.

These and other various polarity inversion patterns can then be implemented upon a panel having subpixel repeating group 202 and Patterns 1-4 as a template. For example, a first embodiment of pattern 1 is shown above. The first row repeats the polarities of pattern 1 above and then, for the second row, the polarities are inverted. Then, as shown above, applying alternating 2 row inversion, alternating polarities of R and B in their own color planes may be realized. And the Gs alternate every second row. The second embodiment of Pattern 1 shown above, however, allows for alternating Gs every row.

It will be appreciated that other basis patterns may be suitable that alternate every two or more incidences of a colored subpixel and still achieve desirable results. It will also be appreciated that the techniques described herein may be used in combination with the techniques of the other co-pending applications noted above. For example, the patterns and crossovers described herein could be applied to a TFT backplane that has some or all of its TFT located in different locations with respect to the pixel element. Additionally, there may be reasons when designing the driver to alternate less frequently than every incidence (e.g., G less often than R and/or B) in order to reduce driver complexity or cost.

Figure 3A:
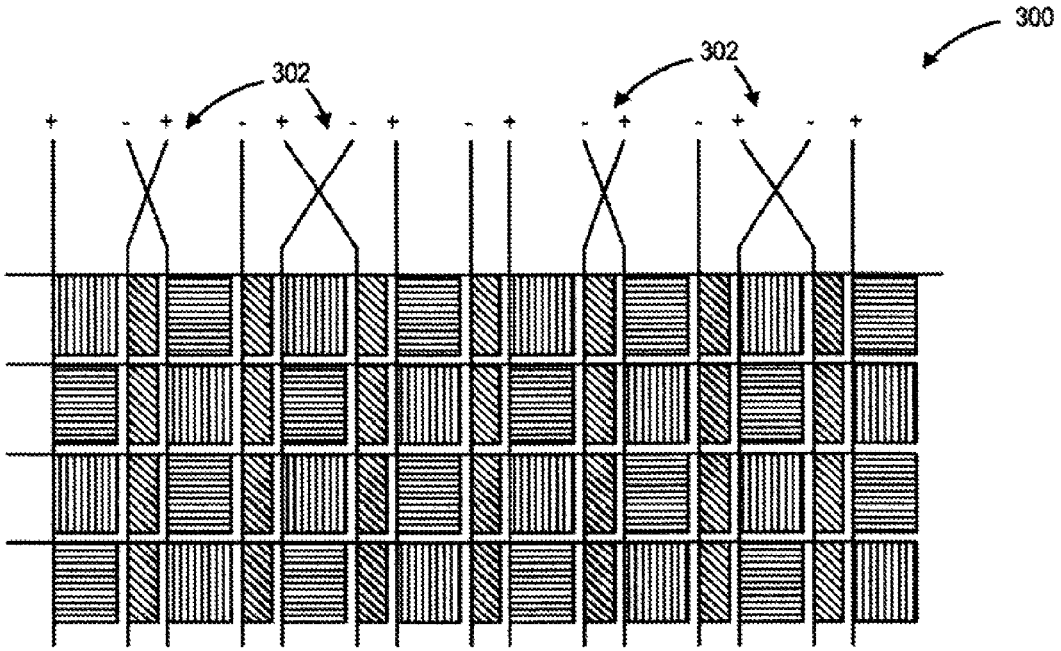
FIGS. 3A and 3B depict the panel display of FIG. 2 with one possible set of crossover connections to provide a dot inversion scheme that may abate some undesirable visual effects.
Figure 3B:
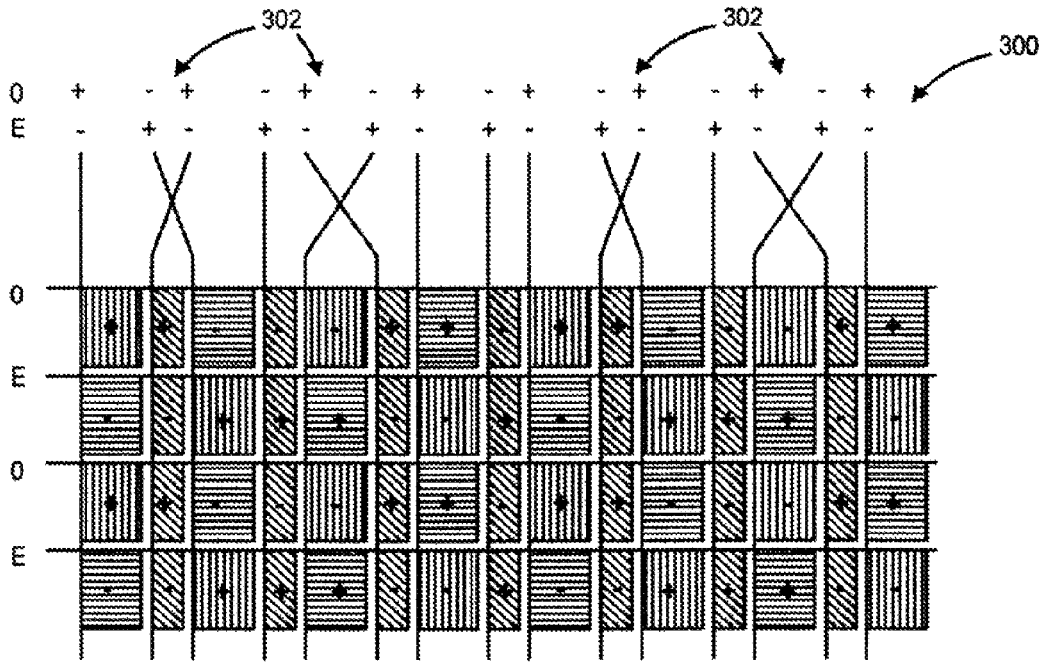

Polarity inversion patterns, such as the ones above, may be implemented at various stages in the system. For example, the driver could be changed to implement the pattern directly. Alternatively, the connections on the panel glass could be rerouted. For example, FIG. 3A is one embodiment of a set of crossover connections that implements Pattern 2 above in a panel 300. Crossovers 302 are added to interchange the column data on columns 2 and 3, 5 and 6, etc. Thus, two crossovers are added in this embodiment per every 8 columns. For a UXGA (1600×1200) panel, this might add approximately 800 crossovers to the column driver set. FIG. 3B depicts how a driver circuit coupled to panel 300 provides image data signals to panel 300 to effect the polarity inversion of Pattern 2 using the set of crossover connections of FIG. 3A. Other patterns may be implemented with different sets of crossovers without departing from the scope of the present invention.

Figure 4:
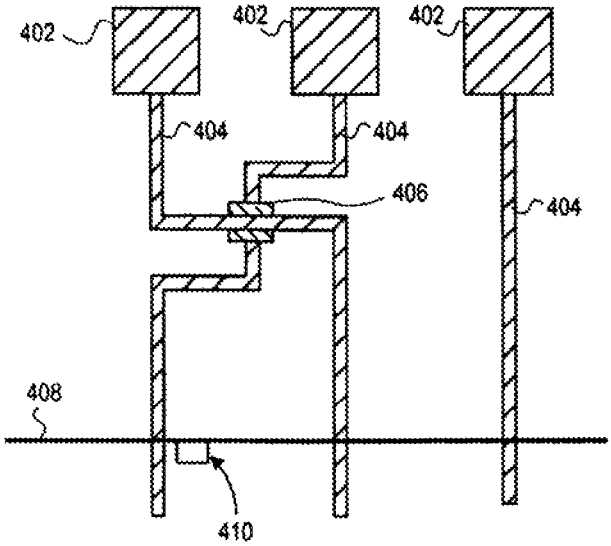
FIG. 4 shows one possible embodiment of a crossover as implemented.

To implement the crossovers, a simple process can be used that utilizes existing processing steps for TFTs. FIG. 4 shows a typical crossover. Driver pads 402 are connected to driver lines 404 which extend down as a column line to intersect with gate lines 408 and send data through TFT 410. Where the drivers are meant to crossover, an insulator layer (406) may be placed so as to prevent shorts and other problems. Driver lines 404 and insulator layer 406 can be fabricated using standard LCD fabrication techniques.

Figure 5A:
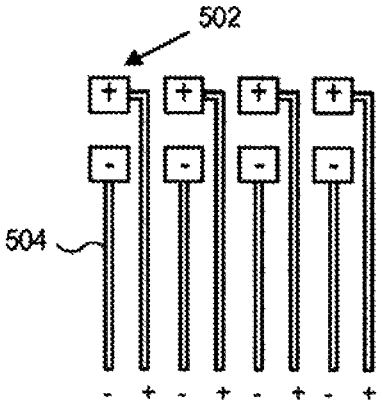
FIGS. 5A and 5B show one possible array of bonding pads without a crossover and with a crossover respectively.
Figure 5B:
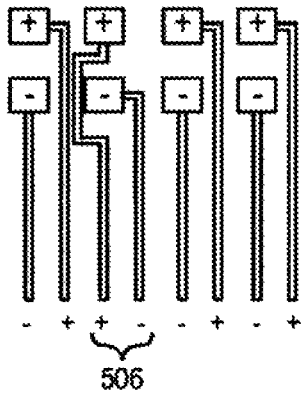

Another embodiment of a crossover is shown in FIGS. 5A and 5B. FIG. 5A shows an array of bonding pads 502. Each pad has a given polarity—the output of which is shown at the bottom of the driver lines 504. For a spacing on the column electrodes of 80 um, the bonding pads shown in FIGS. 5A and 5B are approximately 80 um square with a 80 um space. With such a spacing, it is possible to form crossover 506 as shown in FIG. 5B. As may be seen, this "swap" may be accomplished by rerouting the traces on the glass or the TAB chip carrier as shown.

Figure 6A:
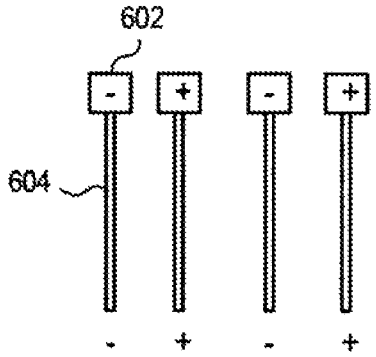
FIGS. 6A and 6B show yet another possible array of bonding pads without a crossover and with a crossover respectively.
Figure 6B:
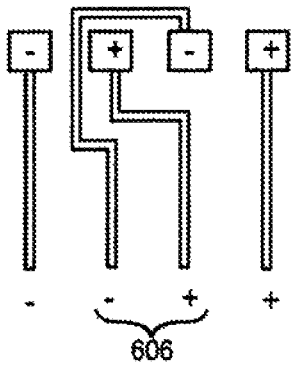

FIGS. 6A and 6B show yet another embodiment of crossover connections to implement polarity patterns as described above. FIG. 6A depicts the bonding pads 602 as another array of such pads—each pad effecting a polarity on the column lines 604, the polarity of which is shown at the bottom of each such line. FIG. 6B shows how a crossover 606 could be effected with such a pad structure. As alternative embodiments, the bonding pads could be for chip on glass COG or for inner lead or outer lead bonds on a tape chip carrier. In such a case, with 80 um column spacing, the bonding pads are now 40 um with 40 um space—i.e. with enough room to route the leads as shown.

Figure 7:
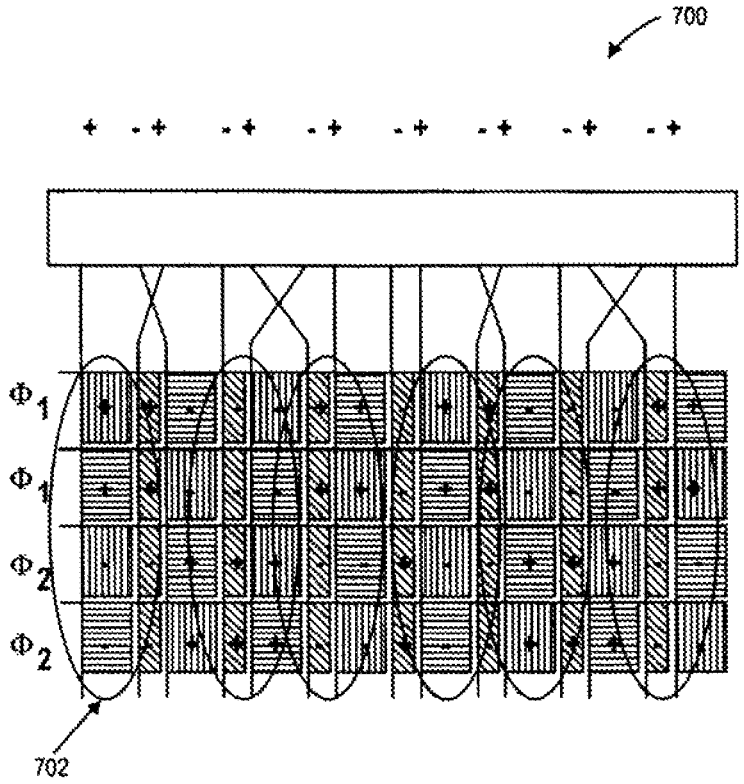
FIG. 7 depicts columns that might be adversely impacted by the effect of crossovers, if no compensation is applied.

One possible drawback to the crossovers is a potential visual effect wherein every crossover location may have a visually darker or lighter column—if this effect is not compensated. FIG. 7 shows one embodiment of a panel 700 having crossovers. On the columns that have crossovers, such as column 702 and other columns as circled, these columns may be slightly darker or lighter than the other columns. This effect is caused by coupling capacitance between the source (data) lines and the pixel electrodes. Normally, each source line is the opposite polarity so the coupling of extraneous voltages is canceled on the pixel electrode. If the source lines are the same polarity, then the pixel voltage will be reduced and the pixel column will appear darker or lighter. This effect is generally independent of the data voltages and can be compensated by a correction signal added to the voltage of the dark or light column. Furthermore, this visual effect can occur when horizontally adjacent pixels have the same polarity. The mechanism for the darkening or lightening is the parasitic capacitance between the data line to the pixel electrode. When the two adjacent data lines, one on the right of the affected pixel and one on the left of the affected pixel, are of opposite polarity, the effect of the parasitic coupling from each data line tends to cancel each other. However, when the polarities of each data line are the same, they will not cancel each other, and there will be a net bias applied to the pixel electrode. This net bias will have the effect or lowering the magnitude of the pixel electrode voltage. For normally black LCD panels, the effect will be to darken the pixel. For normally white LCD panels, the effect will be to lighten the pixel.

Figure 8:
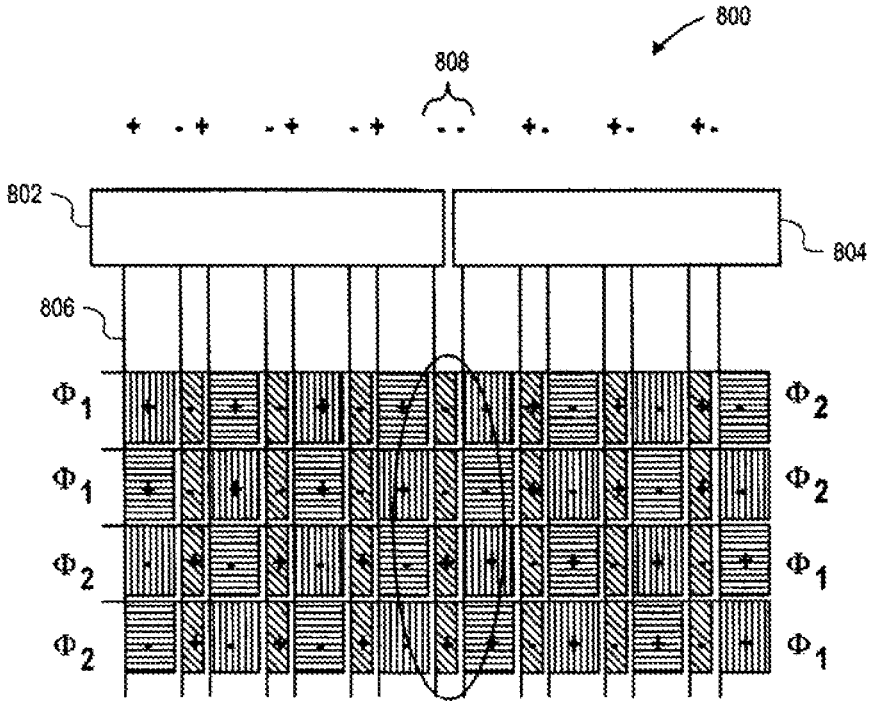
FIG. 8 depicts another solution to some undesirable visual effects on a repeat subgrouping of even modulo, with a change in dot inversion at driver chip boundaries.

This same darker or lighter column effect occurs in another possible solution to the problem of image degradation or shadowing if same colored pixels have the same polarity along a row for an extended area on the screen. FIG. 8 shows a panel 800 having the same subpixel repeating subgrouping as FIG. 2. Standard driver chips 802 and 804 are used to drive the column lines 806—and effecting a 1×2 dot inversion scheme as shown. Although same color subpixels across a row under one such chip (say 802) and might cause some shadowing, this visual effect is somewhat abated by reversing the inversion scheme at the chip boundary 808. It may now be seen that the same colored subpixels under chip 804 will have different polarities as those under chip 802 which abates the shadowing. However, the column at the chip boundary 808 will be darker or lighter than the other columns—unless compensated.

In order to correct or otherwise compensate for the darker or lighter columns that occur as described herein, a predetermined voltage can be added to the data voltage on the darker or lighter columns so as to compensate for the dark or light column. This correction voltage is independent of the data voltage so can be added as a fixed amount to all darker or lighter columns. This correction value can be stored in a ROM incorporated in the driver electronics.

A second compensation method is the look forward compensation method. In this method, each of the data values of the pixels connected to data lines adjacent to the affect pixel are examined for the subsequent frame. From these values, an average compensation value can be calculated and applied to the affected pixel. The compensation value can be derived to a precision suitable to the application. This method requires a frame buffer to store the next frame worth of data. From this stored data, the compensation value would be derived.

A third method is the look back method. Under the assumption that the frame to frame difference in the compensation value is negligible, the data from the previous frame's data may be used to calculate the compensation value for the affected pixel. This method will generally provide a more accurate compensation value than the first method without requiring the frame buffer described in the second method. The third method may have the greatest error under some specific scene changes. By detecting the occurrence of those scene changes, the look back compensation may be turned off, and an alternate method, such as no compensation or either of the compensation methods described above, may be applied for that circumstance.

For the above implementations and embodiments, it is not necessary that crossover connections or polarity inversions be placed for every occurrence of a subpixel repeating group. Indeed, while it might be desirable to have no two incidences of a same-colored subpixel having the same polarity, the visual effect and performance of the panel, from a user's standpoint, might be good enough to abate any undesirable visual effects by allowing some two or more incidences of same-colored subpixels (in either a row or column direction) to have the same polarity. Thus, it suffices for the purposes of the present invention that there could be fewer crossover connections or polarity inversions to achieve a reasonable abatement of bad effects. Any fewer number of crossover connections or polarity inversions could be determined empirically or heuristically, while noting the visual effects thereof, in order to achieve satisfactory performance from a user's standpoint.

What is claimed is:

1. A display device, comprising:

a plurality of subpixel repeating groups arranged in a row direction, each subpixel repeating group consisting of four subpixels in the row direction, the subpixels of the subpixel repeating group comprising at least three colors, wherein adjacent subpixel repeating groups have a same color configuration; and a data driver configured to control polarities of the subpixels such that all the subpixels of the same color that are closest to each other in the row direction have opposite polarities during a current frame.

2. The display device of claim 1, wherein each subpixel repeating group comprises odd-numbered subpixels and even-numbered subpixels alternately arranged in a row direction, the even-numbered subpixels having a size different from the odd-numbered subpixels.

3. The display device of claim 1, further comprising:

a plurality of driver lines electrically connected to the subpixels; and a plurality of signal pads arranged in the row direction, each of the signal pads electrically connected to a corresponding one of the driver lines, wherein a first driver line crosses a second driver line adjacent to the first driver line, and is insulated from the second driver line.

4. The display device of claim 1, further comprising:

a plurality of driver lines electrically connected to the subpixels; and a plurality of signal pads arranged in a first row and in a second row, each of the signal pads electrically connected to a corresponding one of the driver lines, wherein the second row is disposed between the first row and the subpixels, and a first signal pad and a second signal pad that are consecutively adjacent to each other in a same row, are connected to a first driver line and a second driver line, which are consecutively adjacent to each other and connected to the subpixels that are consecutively adjacent to each other.

5. The display device of claim 1, further comprising:

a plurality of driver lines electrically connected to the subpixels, the plurality of driver lines comprising a first driver line and a second driver line; and a plurality of signal pads arranged in a row direction, each of the signal pads electrically connected to a corresponding one of the driver lines, the plurality of signal pads comprising a first signal pad and a second signal pad, wherein the first signal pad is electrically connected to a first subpixel through the first driver line, and the second signal pad spaced apart from the first signal pad in a first direction is electrically connected to a second subpixel spaced apart from the first subpixel in a second direction opposite to the first direction through the second driver line, and the second driver line bypasses the first signal pad and the first driver line without crossover to be connected to the second subpixel.

6. The display device of claim 1, wherein the data driver is further configured to control the polarities of the subpixels such that at least one subpixel has a different polarity than the other subpixels in each subpixel repeating group.

7. The display device of claim 1, wherein the four subpixels in each subpixel repeating group consist of a first subpixel, a second subpixel, a third subpixel, and a fourth subpixel disposed consecutive and adjacent to one another, and wherein the second subpixel and the fourth subpixel are of a same color.

8. The display device of claim 7, wherein the first subpixel is red, the second and fourth subpixels are green, and the third subpixel is blue.

* * * * *